US009190032B2

(12) United States Patent
Heuss

(10) Patent No.: US 9,190,032 B2
(45) Date of Patent: Nov. 17, 2015

(54) GUITAR STRING TUNING AND ANCHOR SYSTEM

(71) Applicant: Hankscraft Inc., Reedsburg, WI (US)

(72) Inventor: David M. Heuss, Lake Mills, WI (US)

(73) Assignee: Hankscraft, Inc., Reedsburg, WI (US)

( * ) Notice: Subject to any disclaimer, the term of this patent is extended or adjusted under 35 U.S.C. 154(b) by 0 days.

(21) Appl. No.: 14/249,543

(22) Filed: Apr. 10, 2014

(65) Prior Publication Data

US 2015/0294651 A1 Oct. 15, 2015

Related U.S. Application Data

(63) Continuation-in-part of application No. 14/166,400, filed on Jan. 28, 2014.

(51) Int. Cl.
*G10D 3/12* (2006.01)
*G10D 3/04* (2006.01)

(52) U.S. Cl.
CPC ..... *G10D 3/04* (2013.01)

(58) Field of Classification Search
USPC ..... 84/298
See application file for complete search history.

(56) References Cited

U.S. PATENT DOCUMENTS 572,677 A 12/1896 Goodwin
976,428 A 11/1910 Benson
4,197,779 A 4/1980 Holman
4,202,240 A 5/1980 Smith
4,366,740 A 1/1983 Tripp
4,608,905 A 9/1986 Takabayashi
4,608,906 A * 9/1986 Takabayashi ..... 84/313
4,696,218 A 9/1987 Hoshino et al.
4,724,737 A * 2/1988 Fender ..... 84/313
4,807,508 A 2/1989 Yairi
5,260,505 A 11/1993 Kendall
5,477,764 A 12/1995 Carrico
5,542,330 A * 8/1996 Borisoff ..... G10D 3/143 84/298

(Continued)

FOREIGN PATENT DOCUMENTS

EP 2135235 B1 11/2012
KR 1020110002945 A 1/2011
WO 0033290 6/2000

OTHER PUBLICATIONS

Quick Stringing Bridge Plate Protection Easy Installation—No Modification Power Pins TM, BigRock Engineering Guitar Accessories, 2012-2013, 2pgs, www.bigrockeng.com.

(Continued)

*Primary Examiner* — Christopher Uhlir
(74) *Attorney, Agent, or Firm* — Merchant & Gould PC

(57) ABSTRACT

An apparatus for securing one end of a guitar string to a guitar is disclosed. The apparatus includes a mount adapted to be secured to and extend upwardly from the bridge of the guitar, and where the mount defines a pivot axis above the bridge of the guitar. The apparatus also can include a string holder pivotally connected to the mount at the pivot axis, the string holder comprising an anchor to securely hold the end of the guitar string, the string holder having a first end and a second end, the first end positioning the guitar string below the saddle height of the bridge. Additionally, the apparatus can include a position adjuster operatively connected to the mount and the string holder, where the position adjuster can be used for adjusting the pivot angle of the string holder to adjust tension on the guitar string.

18 Claims, 9 Drawing Sheets

(56) References Cited

U.S. PATENT DOCUMENTS

| | | | | |
|---|---|---|---|---|
| 5,696,335 | A | 12/1997 | Rose | |
| 6,111,176 | A | 8/2000 | Rose | |
| 6,143,967 | A | 11/2000 | Smith et al. | |
| 6,818,814 | B2 | 11/2004 | Park | |
| 7,112,733 | B1 | 9/2006 | Babicz | |
| 7,351,895 | B1 * | 4/2008 | LeBlanc | G10D 3/04 84/298 |
| 7,394,005 | B1 | 7/2008 | Anderson et al. | |
| 7,566,823 | B1 | 7/2009 | Niskanen | |
| 7,847,170 | B1 | 12/2010 | Anderson et al. | |
| D662,128 | S | 6/2012 | Nuttall | |
| 2003/0177883 | A1 * | 9/2003 | Rose et al. | 84/298 |
| 2007/0214932 | A1 * | 9/2007 | Stalans | G10D 3/12 84/300 |
| 2010/0000392 | A1 | 1/2010 | Uberbacher | |
| 2012/0318117 | A1 * | 12/2012 | Deck | G10D 3/146 84/313 |
| 2014/0311317 | A1 | 10/2014 | Gray et al. | |

OTHER PUBLICATIONS

Acoustic Nation, Product Spotlight: Power Pins, Guitar World, 2013, 5pgs, www.guitarworld.com, NewBay Media, LLC (NY).

PCT/ISA/220, Notification of Transmittal of the International Search Report and The Written Opinion of the International Searching Authority, or the Declaration, May 8, 2015, 13 pgs.

* cited by examiner

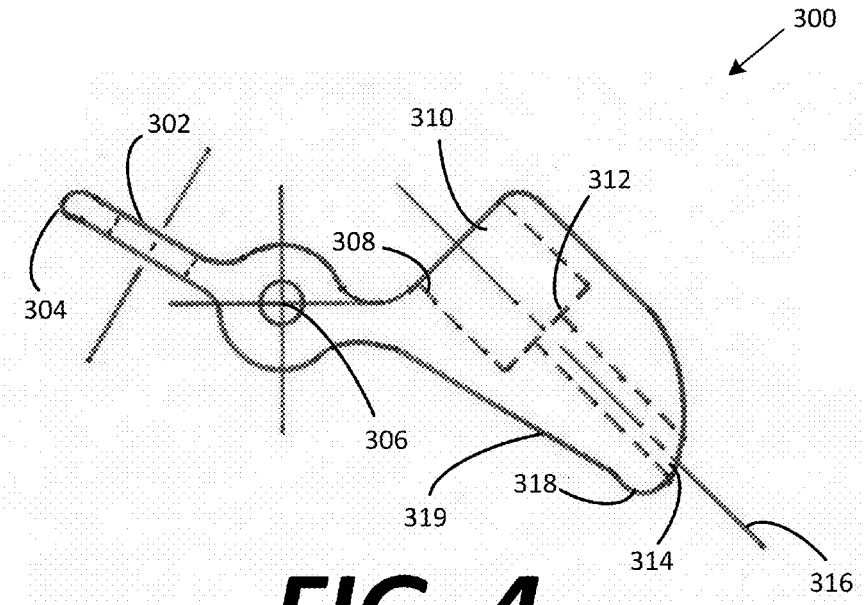
FIG. 4
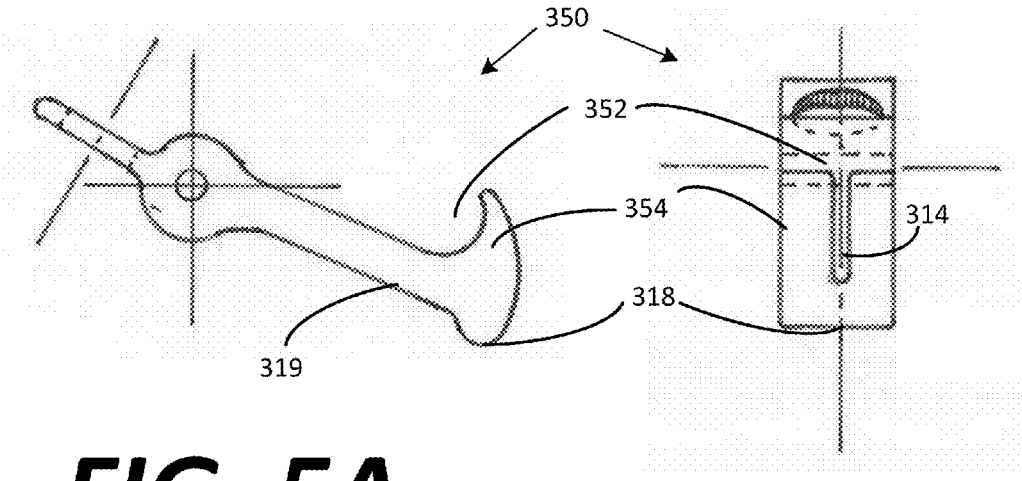
FIG. 5A
FIG. 5B

GUITAR STRING TUNING AND ANCHOR SYSTEM

CROSS REFERENCE TO RELATED APPLICATION

The present application is a continuation-in-part of, and claims the benefit of, U.S. application Ser. No. 14/166,400, filed Jan. 28, 2014, the entirety of which is hereby incorporated by reference.

BACKGROUND

Guitar strings must be secured to a guitar on two ends. At the end of the guitar neck, tuning pegs serve as one anchor point. At the opposite end, in guitars such as acoustic guitars, the guitar string passes over a saddle supported by the bridge and is secured by a pin that forms an interference fit in a hole in the bridge.

Most electric guitars, in contrast, do not employ a hole and pin method of securing a guitar string to a guitar. Instead, the ball end of the guitar string is held in place by u-shaped stoppers aligned on the bridge.

It is with respect to this general environment that the embodiments of the present application are directed.

SUMMARY

In summary, the present disclosure relates to an apparatus for securing one end of a guitar string at the bridge of a guitar.

In a first aspect, the apparatus for securing one end of a guitar string on the end opposite the headstock includes a mount adapted to be secured to and extend upwardly from the guitar, and where the mount defines a pivot axis above the bridge of the guitar that is generally perpendicular to the string direction. The apparatus also can include a string holder pivotally connected to the mount at the pivot axis, the string holder comprising an anchor portion to securely hold the end of the guitar string, the string holder having a first end portion and a second end portion, the first end portion positioning the guitar string below the saddle height of the bridge. Additionally, the apparatus can include a position adjuster operatively connected to the mount and the string holder, the position adjuster adjusting the pivot angle of the string holder to adjust tension on the guitar string. The position adjuster can have a longitudinal axis. The pivot angle can be defined as the angle between the plane perpendicular to the pivot axis and the plane perpendicular to the longitudinal axis of the position adjuster.

In additional aspects, the apparatus can include a string guide positioned proximate to the first end of the string holder to keep the guitar string aligned with the string holder. Also, the string guide can be a notch defined by the first end of the string holder. Further, the string guide can be a vertical channel extending from the anchor toward the first end of the string holder.

In still other aspects, the anchor can hold the end of the guitar string when the guitar string is under tension. Also, the anchor can include a cradle and wall configured to hold the ball end of the guitar string. In some aspects, the position adjuster can be a threaded fastener and the mount further comprises an extension defining a threaded hole operatively receiving the position adjuster. In some aspects the position adjuster is a thumbscrew. In some aspects, the second end of the string holder can define a clearance hole receiving the position adjuster. In some aspects, the apparatus can also include a fastener adapted to secure the mount to the bridge.

In some aspects, the pivot angle of the string holder ranges from approximately 0° to approximately 50°. In some aspects, the minimum pivot angle of the string holder is selected from approximately 0°, approximately 5°, and approximately 10°, and a maximum pivot angle is selected from approximately 30°, approximately 40°, approximately 45°, approximately 60° and approximately 90°.

In another aspect, a method for stringing a guitar string on a guitar is contemplated. The method can include positioning the ball end of the guitar string in an anchoring portion of a string holder, the string holder pivotally connected to a mount at a pivot axis, where the anchor securely holds the ball end of the guitar string and where the mount is fastened to the bridge of the acoustic guitar. Additionally, the method can include securing the non-ball end of the guitar string to a tuning peg at the headstock and adjusting the string tension using a position adjuster operatively connected to the mount and the string holder, the position adjuster adjusting the pivot angle of the string holder.

In yet another aspect, an apparatus for securing one end of a guitar string to a guitar on an opposing end from the head stock is contemplated. The apparatus can include a mount adapted to be secured to and extend upwardly from the guitar, the mount defining a pivot axis generally perpendicular to the string direction. Also, the apparatus can include a string holder pivotally connected to the mount at the pivot axis, the string holder comprising an anchor portion for securely holding the end of the guitar string, the string holder having a first end portion and a second end portion, the first end portion positioning the guitar string below a saddle height of the bridge. The apparatus can also include a position adjuster operatively connected to the mount and the string holder, the position adjuster raising or lowering a point of contact between the saddle and the string holder, wherein the raising or lowering of the point of contact is relative to the plane of the guitar.

BRIEF DESCRIPTION OF THE DRAWINGS

FIG. 4 is a side view illustrating a string holder according to an example embodiment of the present disclosure;

FIG. 5A is a side view illustrating a string holder according to an additional example embodiment of the present disclosure;

FIG. 5B is a front view illustrating a string holder according to the additional example embodiment of FIG. 5A;

DETAILED DESCRIPTION

As briefly described above, embodiments of the present invention are directed to securing a guitar string to a guitar. Known securing means have multiple deficiencies. For instance, the pegs used to secure the string in the bridge hole can be tapered and difficult to extract. The pegs can be particularly difficult to extract when the pegs have been driven into the bridge with a lot of force. Also, the pegs can pop out of the hole if not properly secured. When the peg pops out of the hole, the string loses tension and the guitar can become unplayable. This is unacceptable, especially during a live performance. Additionally, the pegs can break when they are being removed from the bridge holes. This can leave part of the peg stuck in the bridge hole, which can be difficult to remove safely and without damaging the guitar. Another problem with current peg-in-hole systems is that no standard bridge hole exists, which complicates the replacement process when a peg breaks or is lost. Thus, finding an appropriately sized peg can be a challenge and if the peg is too small, it can fall out, but if the peg is too large it will not push all the way into the bridge. Still another problem with existing securing means is that changing a guitar string can be time consuming and awkward. Again, this is unacceptable during a live performance.

Figure 1:
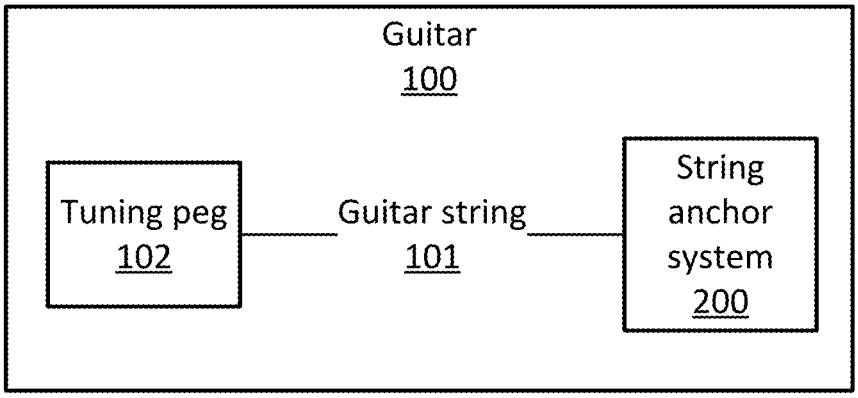
FIG. 1 is a general-purpose block diagram of an example guitar fitted with a string anchor system according to an example embodiment of the present disclosure.

Referring now to FIG. 1, a general block diagram of an example guitar 100 with a string anchor system 200 is shown. The example guitar 100 is an acoustic guitar and includes a guitar string 101, where a tuning peg 102 secures a first end portion of the string 101 and a string anchor system 200 secures a second end portion of the string 101. In some embodiments, the guitar 100 is a different string instrument, such as, for example, a double bass, a viola, a violin, a cello, a sitar, a harp, or a lute.

The tuning peg 102 secures the first end of the guitar string 101 and can be any tuning peg known in the art. The guitar string 101 can be made of a single material, such as, for example, steel, nylon, gut, or brass, or the guitar string 101 can be a wound string comprising a core and an overwinding. The guitar string 101 has a ball end, where the ball can be any polyhedra known in the art, such as, a cylinder, a sphere, a hemisphere, prism or a pyramid.

The example string anchor system 200 secures the second end of the guitar string 101. Example embodiments of the string anchor system 200 are shown and described in more detail herein with reference to FIGS. 2-10. The string anchor system 200 can be sized to fit various string instruments. The string anchor system 200 can be retrofitted into previously-constructed string instruments and/or used in the construction of a new string instrument.

The string anchor system 200 can be manufactured using rapid prototyping methods, such as, for example, additive manufacturing (also known as 3D printing), CNC milling, or other techniques known in the art.

Figure 2:
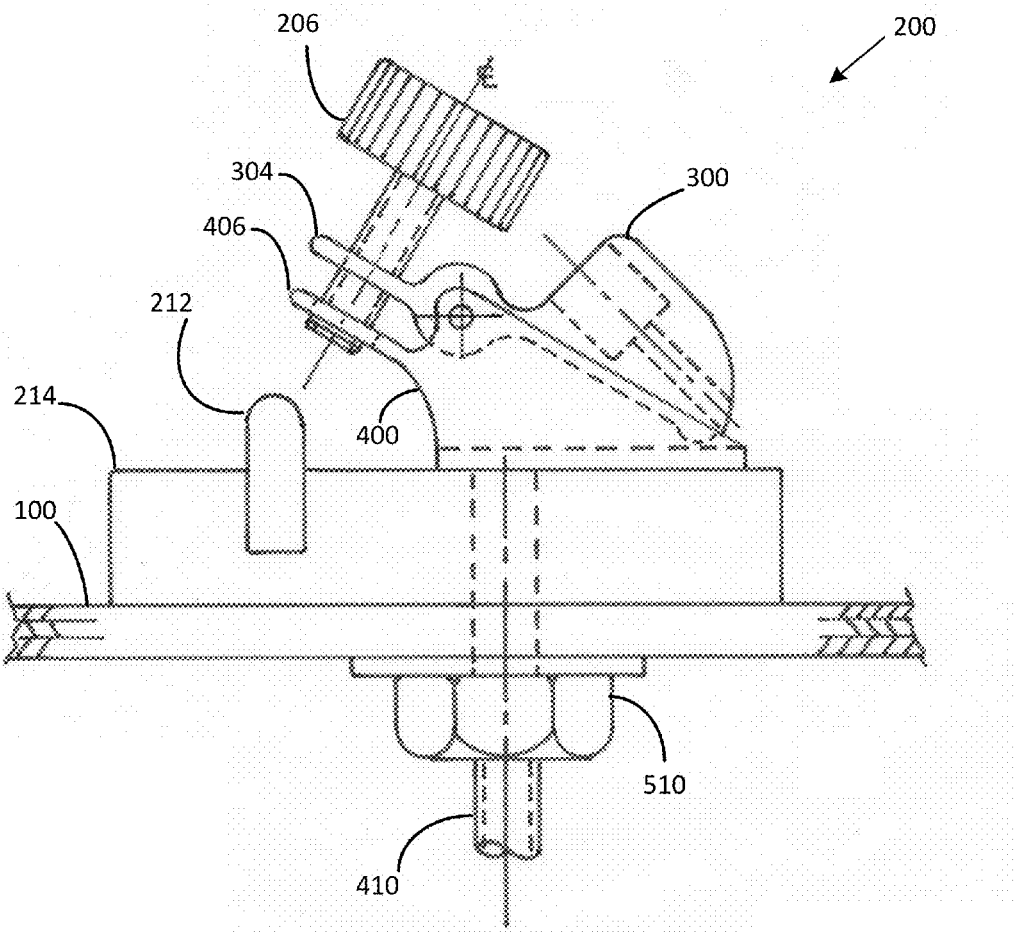
FIG. 2 is a side view illustrating a string anchor system according to an example embodiment of the present disclosure.
Figure 3:
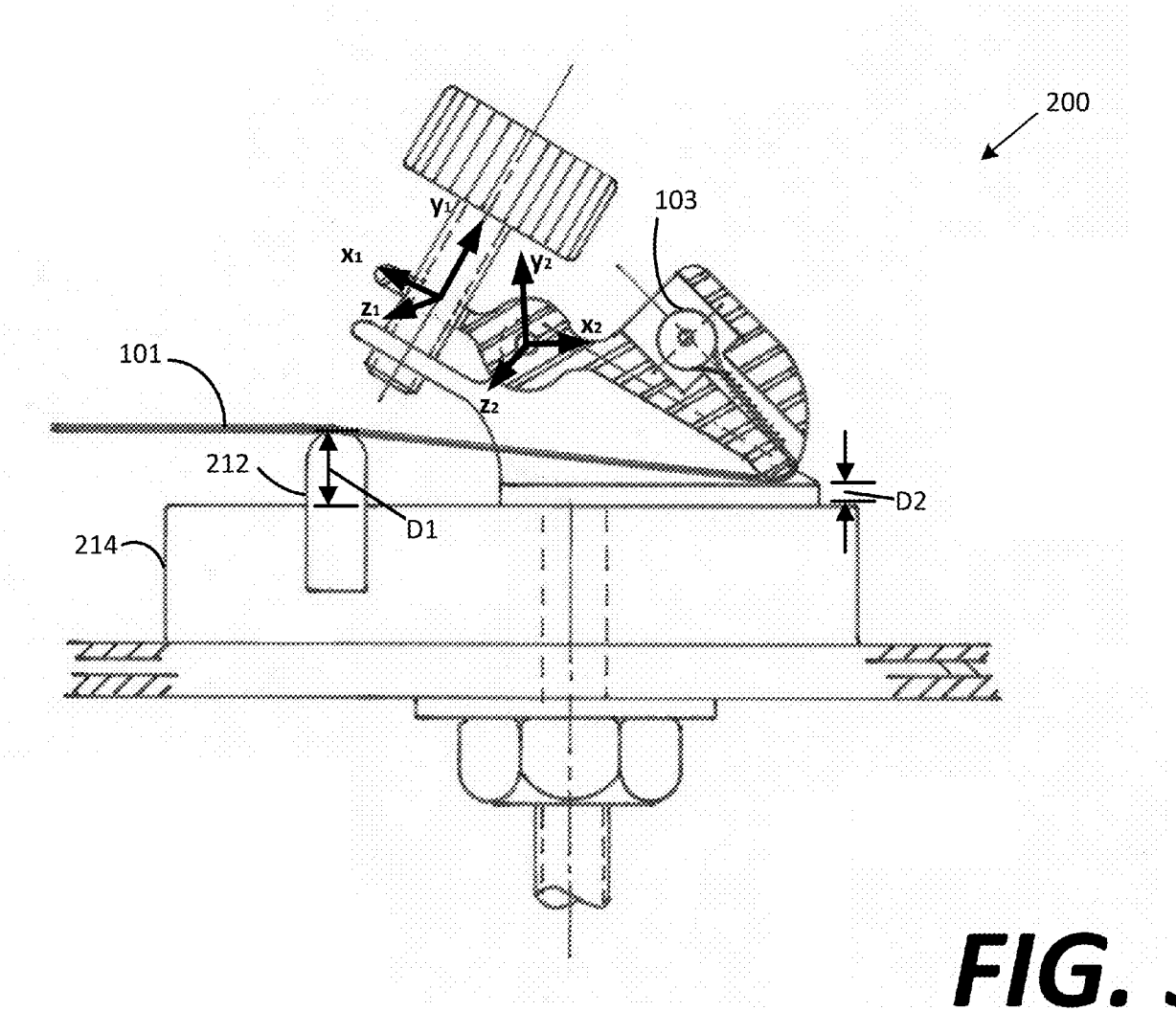
FIG. 3 a side view illustrating a string anchor system with a guitar string according to an example embodiment of the present disclosure.

FIGS. 2 and 3 illustrate an example embodiment of a guitar string anchor system 200. The example embodiment system 200 shown in FIG. 2 includes a mount 400 with a tab 406, extension 410 and fastener 510, a string holder 300 with a tab 304, and a position adjuster 206. Also depicted for reference is a saddle 212, a bridge 214, and the guitar 100. FIG. 3 depicts the same components but also shows one possible arrangement of a guitar string 101 and ball end 103 in the example anchor system 200.

In some embodiments, the example mount 400 supports the string holder 300 and secures to the bridge 214. The example extension 410 fits into a peg hole of the guitar 100. A description of an example extension 410 is provided at least with reference to FIG. 6 below.

The example mount 400, when installed, fits flush against the bridge. Other embodiments are possible, where only part of the mount 400 fits flush against the bridge. Additionally, in some embodiments, mount 400 secures directly to the guitar and not to the bridge 214. To ensure the mount 400 has a snug fit against the bridge 214, a fastener 510 is used in some embodiments. As shown in FIGS. 2 and 3, the example fastener 510 can be a nut and washer, where the nut screws onto a threaded extension 410. Alternate embodiments of fastener 510 are possible. For example, fastener 510 and extension 410 could be a rivet or extension 410 could have deployable flanges or expanding barbs to brace against the underside of the guitar 100.

In some embodiments, the example mount 400 also has a threaded hole in tab 406. In those embodiments, the relative position of position adjuster 206, which has a threaded exterior, can be adjusted. More views of example embodiments of mount 400 are shown and described in more detail with reference to FIGS. 6-8.

The example string holder 300 is supported by the mount 400 and is configured to hold the guitar string 101 in place and has a cavity to receive the ball end of the string 103. In some embodiments, the string holder 300 can pivot in a direction towards the guitar 100 or away from the guitar 100. In some embodiments, the amount of pivot can be adjusted by the position adjuster 206. Other configurations for adjusting the amount of pivot are possible. Example embodiments of the string holder 300 are shown and described in more detail with reference to FIGS. 4-5, below.

In some embodiments, the position adjuster 206, which is operatively connected to pivot the string holder 300, can be used to fine tune the guitar string 101. That is, by rotating the position adjuster 206 in one direction, say clockwise, the string holder's contact point 318 can pivot away from the bridge 214, which can result in a tightening of the string 101. In most circumstances, tightening the string 101 results in a higher pitch produced by the string 101. Alternatively, by rotating the position adjuster 206 in a different direction, say counter-clockwise, the string holder's contact point 318 can pivot towards the bridge 214, which can result in lower tension and thus a lower pitch produced by the string 101.

In some embodiments, after the string 101 has been attached to the anchor 200 and the tuning peg, the pitch of the string 101 can be "fine-tuned" using the position adjuster 206, which can incrementally increase or decrease the string 101 tension. That is, the position adjuster 206 in combination with the string holder 300, can provide a more precise adjustment of the guitar string tension than the mechanical tuners at the headstock. Additionally, in some embodiments, the more precise adjustment capability can assist in alternate tunings of a guitar, such as, for example, tunings categorized as dropped, for example "drop D", open, for example "open D", cross-note, modal, instrumental and miscellaneous.

In alternate embodiments, the string tension can be incrementally adjusted using a different arrangement than that shown in FIG. 2. For example, a gear mechanism can be used to pivot the string holder 300. In some embodiments, the anchor system 200 additionally includes a string holder 300 lock, not pictured, to ensure the string tension does not change after adjustment and during playing. Other embodiments where one or more components act together to incrementally adjust the string tension, and optionally including a lock mechanism to hold that tension, and hold the string holder 300 in a position, are within the scope of this disclosure.

Referring now to FIG. 3, an example configuration of the guitar string 101 and the guitar string ball 103 in the anchor system 200 is shown. In the example embodiment, the string 101 passes over the saddle 212 at height D1 from the bridge 214. The height of the string decreases between the saddle and the string holder 300 to a height D2 from the bridge 214. In some embodiments, D1 is greater than D2 to improve the sound and playability of the string 101.

In some embodiments, the position adjuster 206 is used to adjust pivot angle of the string holder 300. FIG. 3 shows the $x_1$-$y_1$-$z_1$ planes for the position adjuster 206 and the $x_2$-$y_2$-$z_2$ planes for the pivot axis. The longitudinal axis of the position adjuster 206 is the $y_1$ axis. The $y_1$ axis is normal to the $x_1$-$z_1$ plane. The pivot axis is the $z_2$ axis, which is normal to the $x_2$-$y_2$ plane. As used herein, the "pivot angle" is defined as the angle between the $x_1$-$z_1$ plane, and the $x_2$-$y_2$ plane. In some embodiments, the string holder has a pivot angle of from about 0° to about 60°; from about 5° to about 50°; or from about 0° to about 40°. In some embodiments, the minimum pivot angle of the string holder 300 is about 0°; about 5°; about 10°; or about 15°. In some embodiments, the maximum pivot angle of the string holder is about 30°; about 40°; about 45°; about 60°; about 75°; or about 90°.

Referring now to FIG. 4, an example embodiment of the string holder 300 is shown in side view. The example embodiment includes a position adjuster hole 302 on a tab 304, a pivot channel 306, a receiving cavity 310 that includes side walls 308 and floor 312, a threading hole 314 with axis 316, and threading guide 318. String holder 300 can be made of a metal, such as brass, aluminum, steel, iron, or copper. Alternatively, the string holder 300 can be made out of a strong plastic or ceramic. An alternate embodiment of the string holder 300 is provided in FIGS. 5A and 5B, described in more detail below.

In some embodiments, the string holder 300 has a tab 304 or a similar extension that defines a first hole 302 to guide the position adjuster 206. In some embodiments, the first hole 302 is threaded and in other embodiments, the first hole is substantially smooth. In some embodiments, the relative position of the string holder 300 is dictated by the position adjuster's 206 interaction with the first hole 302 and the second hole 408 in mount 400. As shown in FIG. 4, the axis of the hole 302 can be oblique to the plane of pivot channel 306. In other embodiments, not shown in the figures, the axis of hole 302 can be parallel.

In the example shown in FIG. 4, pivot channel 306 is a substantially cylindrical tube whose longitudinal axis runs substantially parallel to the surface of the bridge 214 and substantially perpendicular to the direction of the guitar neck. In some embodiments, a rod or other support apparatus can be positioned through the pivot channel 306 and the ends of the rod or other apparatus additionally pass through and are supported by the mount 400.

In the example embodiment, the end opposite tab 304 includes a receiving cavity 310 for securely holding the ball end 103 of the guitar string 101. The receiving cavity 310 can be substantially cylinder-shaped or any type of prism, provided a face of the cylinder or prism is missing so that the cavity 310 is open. The receiving cavity 310 can be alternatively termed an anchor. Other configurations of the cavity 310 are possible, provided they securely hold the ball end of the guitar string.

The receiving cavity has side walls 308 that can be normal to the floor 312 of the cavity, as shown in FIG. 4. In other embodiments, the side walls 308 can form an acute or obtuse angle, in cross-sectional view, with the floor 312 of the cavity. As depicted in FIG. 4, in some embodiments the floor 312 of the cavity is substantially planar. Other embodiments the floor 312 can be curved or angled.

In some embodiments, a threading hole 314 is provided for the string to pass through. As shown in FIG. 4, threading hole 314 may be substantially cylindrical or prism-shaped. In some embodiments, threading hole 314 is U-shaped or V-shaped; that is, hole 314 is not enclosed. In the embodiment shown in FIG. 4, threading hole 314 has an axis 316 that is substantially normal to the receiving cavity floor 312, however, the axis 316 can be oblique to the floor 312 in other embodiments. In some embodiments, not shown, there can be little to no threading hole 314. In those embodiments, the guitar string can feed substantially straight through from the cavity, to the point of contact 318 and on to the saddle.

In some embodiments, threading guide 318 is the first point of contact on the string holder 300 for the guitar string 101 as it passes from the saddle 212 towards the anchor system 200. In some embodiments, the position adjuster 206 changes the pivot axis of the string holder 300, which moves the threading guide 318, which in turn can adjust the height of the guitar string 101 after the string 101 passes over the saddle 212.

As shown in FIG. 4, threading guide 318, also termed string guide, can be a rounded end. In some embodiments, threading guide 318 can be a notch or a vertical channel extending from the cavity 310 toward the adjacent surface 319. Also, as shown in FIG. 4, threading guide 318 protrudes lower than the adjacent surface 319. In other embodiments, threading guide 318 can be rounded but flush with the adjacent surface 319. That is, the contact point 318 does not extend lower than the adjacent surface 319. In some embodiments, threading guide 318 has a U-shaped or V-shaped channel with a first end continuing from threading hole 314 to a second end that stops substantially at the adjacent surface 319.

In some embodiments, the guitar string 101 can be strung to the guitar by first passing the string into the receiving cavity 310 and through the threading hole 314, then along the threading guide 318, that is, around one end of the string holder 300, over the bridge saddle 212 and then down to the tuning peg 102.

FIGS. 5A and 5B depict side and front views, respectively, of an alternate embodiment of the string holder 350. The embodiment shown in FIGS. 5A and 5B has substantially the same components 302-306 and 314-319 as the embodiment shown in FIG. 4. The embodiment in FIGS. 5A and 5B differs from the embodiment in FIG. 4 at least in the respective receiving cavities 318 and 352. In the example embodiment in FIGS. 5A and 5B, the cavity 352 holds the ball end 103 of the string 101 like a two-pronged claw. The prongs 354 can form an open channel 314, as shown in FIG. 5B, or in some embodiments, the channel 314 can be enclosed.

Figure 6:
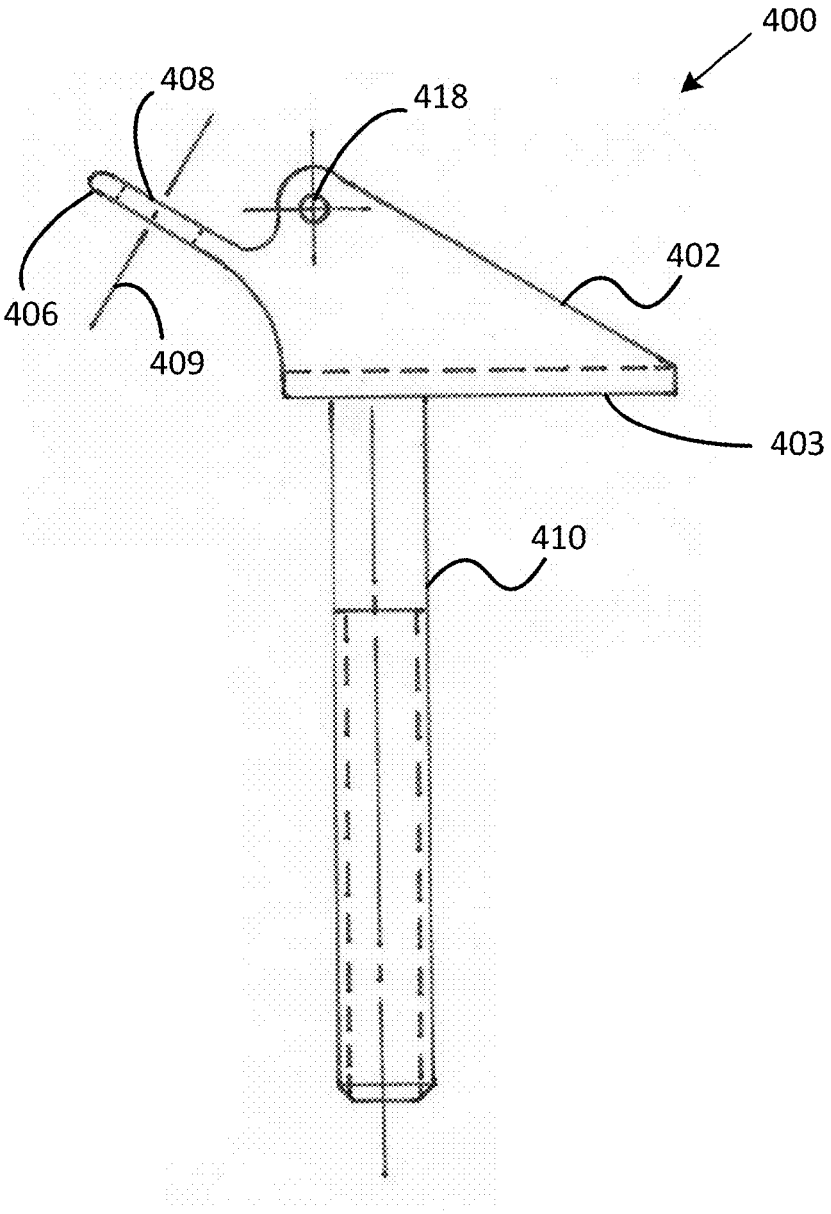
FIG. 6 is a side view illustrating a mount according to an example embodiment of the present disclosure.

FIG. 6 depicts an example embodiment of mount 400 that supports the example string holder 300. The example embodiment mount 400 includes a base portion 402, support slots 418, tab 406 with threaded hole 408, and extension 410 that is connected to the base portion 402. Mount 400 can be made of a metal, such as brass, aluminum, steel, iron, or copper. Alternatively, the mount 400 can be made out of a strong plastic or ceramic. In some embodiments, the base 402 and extension 410 are a single continuous piece. In other embodiments, the base 402 and extension 410 are formed separately but subsequently joined. Alternate embodiments of the mount are provided in FIGS. 7 and 8, described in more detail below.

In some embodiments, base 402 supports the string holder 300. In some embodiments, the bottom surface 403 of the base 403 sits flush against the guitar bridge 214 when installed.

In a front view of base 402, not shown, the base comprises two sides extending substantially upward from the bottom 403 in a substantially U-shaped arrangement. In some embodiments, the string holder 300 is positioned substantially between the two U-shaped sides.

In some embodiments, each side has a hole 418 through which a rod or other support apparatus can pass, where the rod in combination with the holes 418 support the string holder 300. In some embodiments, one or both ends of the rod or support apparatus that passes through holes 418 have a fastening element configured to hold the support apparatus in place.

Some embodiments of mount 400 have a tab 406 extending on one end. In those embodiments, tab 406 has a hole 408 that can be threaded and can be configured to receive the position adjuster 206. As shown in FIG. 6, the axis of the hole 409 can be oblique to the plane of the mount bottom 403. In other embodiments, not shown in the figures, the axis of hole 409 can be normal to the plane of the mount bottom 403.

Extension 410 is configured to fit into a guitar bridge hole. The example extension 410 can be made of varying diameters and shapes, such as, for example, a cylinder, a hexagonal prism, a threaded cylinder, or any other shape that would fit into a guitar bridge hole. Additionally, the extension 410 can have varying cross-sectional area, such as, for example, a tapered shape where the cross sectional area of the extension 410 increases from the distal end to the mount bottom 403. In some embodiments, a tapered shape of the extension 410 ensures a better fit into the guitar bridge hole than a non-tapered shape. The extension 410 can be threaded, partially threaded, or substantially smooth. As discussed above, in some embodiments, extension 410 has expanding barbs or flanges to brace the mount base 402 against the guitar bridge 212. The extension 410 can also have varying lengths, such as, for example, 1 inch, 1.2 inches, 1.25 inches, 0.75 inch, 0.8 inch, 2 inches, 1.5 inches, 2.5 inches or 3 inches.

Figure 7:
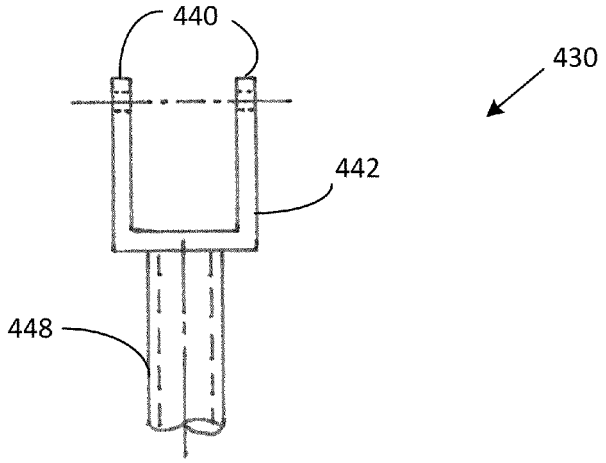
FIG. 7 is a front view illustrating a mount according to an additional example embodiment of the present disclosure.
Figure 9:
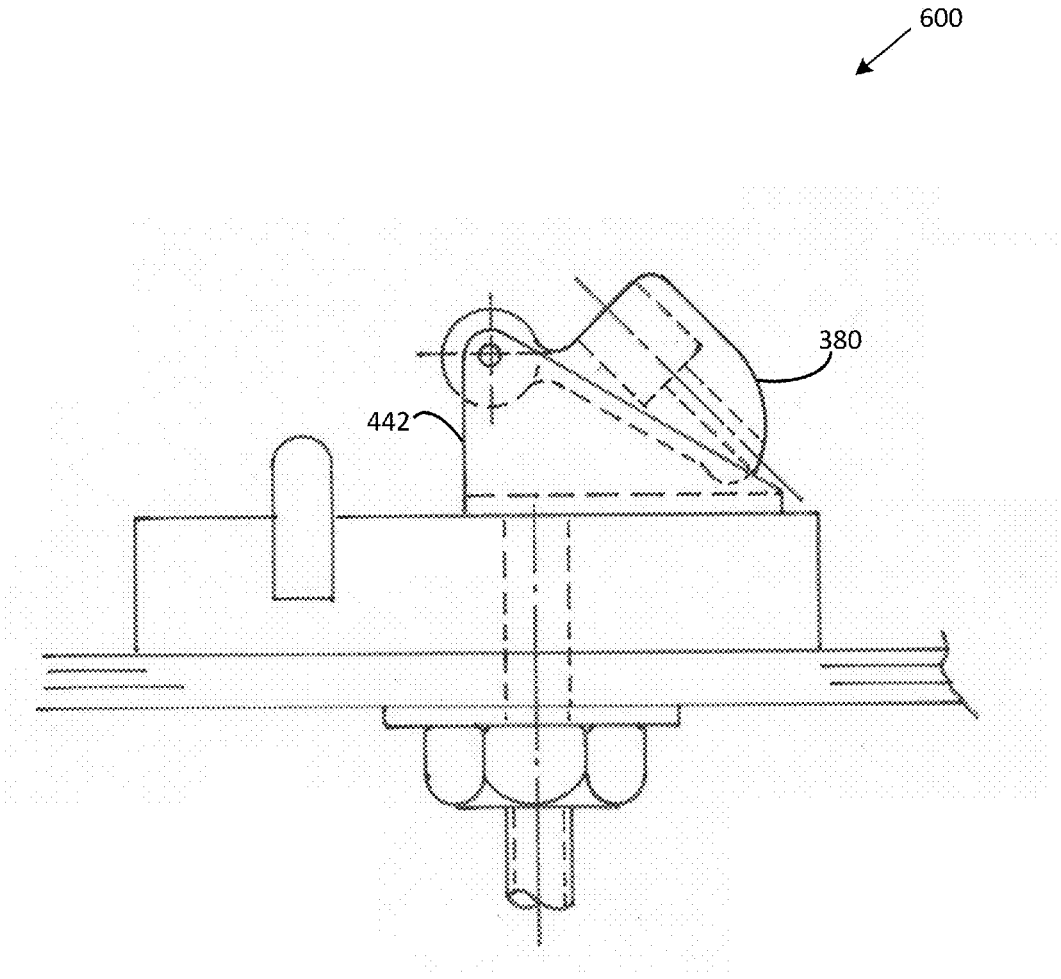
FIG. 9 is a side view illustrating a string anchor system according to an additional example embodiment of the present disclosure.

FIG. 7 is a front view of an alternate embodiment of a mount 430. A side view of example mount 430 is shown in FIG. 9. As shown in FIG. 7, the mount base 442 comprises two sides 440 that form a substantially u-shaped cavity. The example mount 430 can be made of the same materials and in a similar construction as example embodiment 400. Similar to example mount embodiment 400, alternate mount embodiment 430 has two holes to support the string holder 300 and an extension 448 to fit into the guitar bridge hole. Extension 448 can have similar configurations as those described with reference to extension 410.

Figure 8:
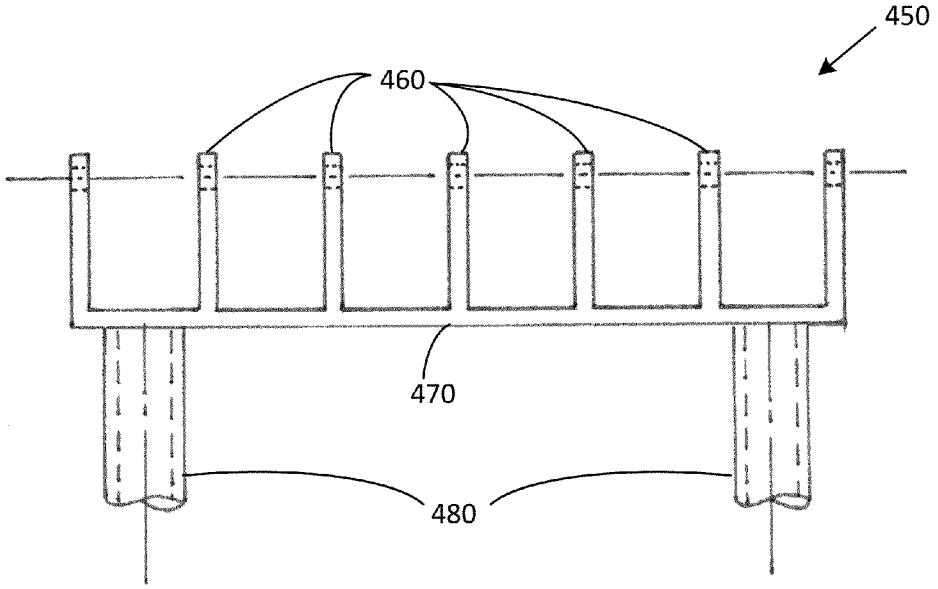
FIG. 8 is a front view illustrating a six-wide mount according to an additional example embodiment of the present disclosure.

FIG. 8 is a front view of an additional alternate embodiment of a mount 450. The embodiment 450 depicted in FIG. 8 differs from earlier embodiments of the mount 400 and 430 in at least a few ways. The example six-wide mount 450 embodiment has five shared sides 460. Also, the example six-wide mount 450 embodiment has two extensions 480. Further, there is one common base 470.

Variations on example mount embodiment 450 are possible. For instance, the six-wide mount can have three, four, five, or six extensions 480. Alternatively, two-wide, three-wide, four-wide and five-wide mounts are possible, each with at least one extension.

In one aspect, a method for using the anchor system 200 to string a guitar string to the guitar is contemplated. In some embodiments, first the non-ball end portion of the guitar string 101 can be fed through the opening 314 or channel of the string guide 300. Then, the string can be pulled through until little to no slack remains in the line between the cavity 310 and the opening of the tube or channel 314. Next, in some embodiments, the non-ball end portion of the guitar string 101 can be secured to the mechanical tuning peg in the headstock. Then, in some embodiments, the mechanical tuning peg can be used to increase the string tension to a first desired tension. Thereafter, in some embodiments, the position adjuster 206 can be used to "fine tune" the string tension, using in some embodiments a separate tuning apparatus. In some embodiments where the position adjuster 206 has a locking mechanism, the user next locks the position adjuster and the string is ready to be played.

FIG. 9 is a side view of an alternate embodiment of a guitar string anchor system 600. The possible configurations of the components are the same as those described with reference to FIGS. 2-8, however, there is no position adjuster 206. In the embodiment shown in FIG. 9, the string holder 380 and the mount 442 do not have tabs with holes, as shown in the embodiments depicted in at least FIG. 2. The string holder 380 is pivotally supported by mount 442. The pivot angle of string holder 380 can be adjusted by pulling or pushing on an end of the string holder 380, and the string holder 380 can be held in place by a support and securing apparatus, such as an alignment pin, for example, an expanding pin with a cam handle, a detent pin, a ball lock pin, or a clamping pin.

Figure 10:
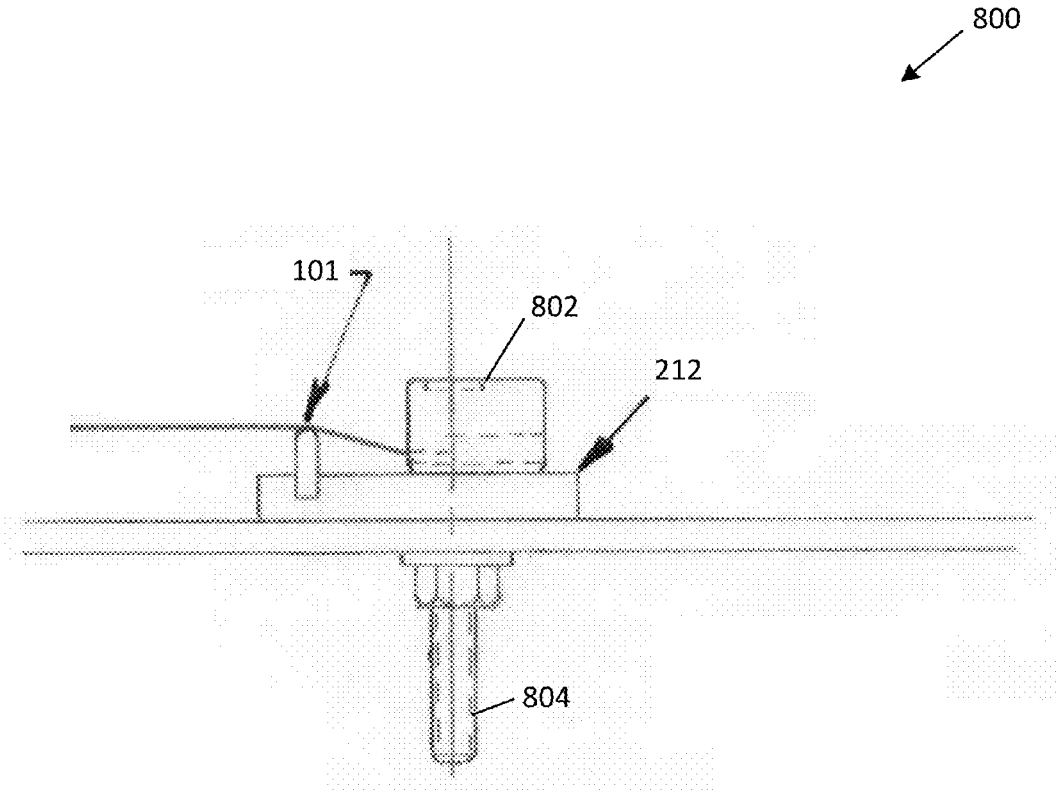
FIG. 10 is a side view illustrating a string anchor system according to an another example embodiment of the present disclosure.
Figure 11A:
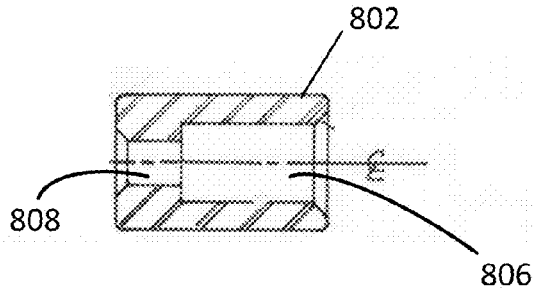
FIG. 11A is a top view of a head of the example embodiment depicted in FIG. 10.
Figure 11B:
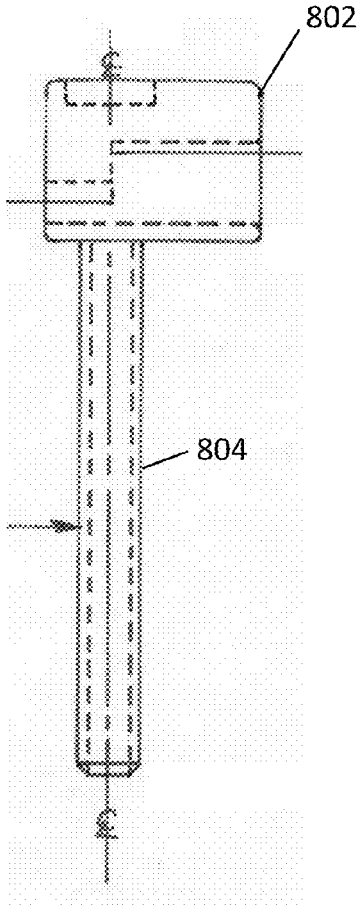
FIG. 11B is a side view of a head of the example embodiment depicted in FIG. 10.

FIGS. 10, 11A and 11B depict an alternate embodiment of a guitar string anchor system 800. The alternate string anchor system embodiment 800 has similar extension 804 and fastening elements, and possible configurations, as those previously described with reference to FIGS. 1-9. Alternate embodiment 800 has a single head 802 that is integral or attached to extension 804. Alternate embodiment 800 does not have a position adjuster 206.

As shown in FIG. 11*a*, head 802 has a receiving cavity 806 that is configured to hold the ball end 103 of a guitar string. Head 802 has a channel 808 for the guitar string to pass through, where the channel 808 is substantially cylindrical or a prism in shape. As shown in FIGS. 10, 11A and 11B, head 802 is substantially shaped as a rectangular prism. Other configurations are possible, provided the head portion 802 does not rock back and forth while the guitar is being played.

The description and illustration of one or more embodiments provided in this application are not intended to limit or restrict the scope of the invention as claimed in any way. The embodiments, examples, and details provided in this application are considered sufficient to convey possession and enable others to make and use the best mode of claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed invention and the general inventive concept embodied in this application that do not depart from the broader scope.

The invention claimed is:

1. An apparatus for securing one end of a guitar string on a guitar on an opposing end from a headstock, the apparatus comprising:

a mount adapted to be secured to and extend upwardly from the guitar, the mount including a pivot channel defining a pivot axis generally perpendicular to the string direction;

a string holder pivotally connected to the mount at the pivot axis, the string holder comprising an anchor portion for securely holding the end of the guitar string such that a portion of the guitar string passes below the end of the guitar string and above the bridge, the string holder having a first end portion and a second end portion, the first end portion positioning the guitar string below a saddle height of a bridge; and a position adjuster operatively connected to the mount and the string holder, the position adjuster adjusting a pivot angle of the string holder to adjust tension on the guitar string, wherein the pivot channel is located between the anchor portion and the position adjuster; wherein the guitar is an acoustic guitar.

2. The apparatus of claim 1, wherein the position adjuster has a longitudinal axis;

wherein the pivot angle is defined as an angle between a plane perpendicular to the pivot axis and a plane perpendicular to the longitudinal axis of the position adjuster.

3. The apparatus of claim 1, further comprising a string guide positioned proximate to the first end of the string holder to keep the guitar string aligned with the string holder.

4. The apparatus of claim 3, wherein the string guide is a notch defined by the first end of the string holder.

5. The apparatus of claim 3, wherein the string guide is a vertical channel extending from the anchor portion toward the first end of the string holder.

6. The apparatus of claim 1 wherein the anchor portion holds the end of the guitar string when the guitar string is under tension.

7. The apparatus of claim 1, wherein the guitar string end includes a ball; and wherein the anchor portion comprises a cradle and a wall configured to hold the ball end of the guitar string.

8. The apparatus of claim 1, wherein the position adjuster is a threaded fastener and the mount further comprises an extension defining a threaded hole operatively receiving the position adjuster.

9. The apparatus of claim 8, wherein the second end of the string holder defines a clearance hole receiving the position adjuster.

10. The apparatus of claim 1, wherein the position adjuster is a thumbscrew.

11. The apparatus of claim 1, wherein the mount extends upward from the bridge of the guitar, and further comprising a fastener adapted to secure the mount to the bridge.

12. The apparatus of claim 1, wherein pivot angle ranges from approximately 0° to approximately 50°.

13. The apparatus of claim 1, wherein the pivot angle has a minimum angle selected from approximately 0°, approximately 5°, and approximately 10° and a maximum angle selected from approximately 30°, approximately 40°, approximately 45°, approximately 50°, and approximately 90°.

14. A method for stringing a guitar string on an acoustic guitar, comprising:

positioning a ball end of the guitar string in an anchoring portion of a string holder, the string holder pivotally connected to a mount at a pivot axis, wherein the anchoring portion securely holds the ball end of the guitar string;

and wherein the mount is fastened to a bridge of the acoustic guitar;

securing the non-ball end of the guitar string to a tuning peg at a headstock such that a portion of the guitar string passes below the ball end of the guitar string and above the bridge of the acoustic guitar; and adjusting the string tension using a position adjuster operatively connected to the mount and the string holder, the position adjuster adjusting a pivot angle of the string holder.

15. An apparatus for securing a ball end of a guitar string to an acoustic guitar on an opposing end from a headstock, the apparatus comprising:

a mount adapted to be secured to and extend upwardly from the acoustic guitar, the mount including a pivot channel defining a pivot axis generally perpendicular to the string direction;

a string holder pivotally connected to the mount at the pivot axis, the string holder comprising an anchor portion for securely holding the ball end of the guitar string, the string holder having a first end portion and a second end portion, the first end portion positioning the guitar string below a saddle height of a bridge, wherein the anchor portion is configured to hold the ball end of the guitar string such that a portion of the guitar string passes directly below the ball end of the guitar string and above the bridge; and a position adjuster operatively connected to the mount and the string holder, the position adjuster raising or lowering a point of contact between a saddle and the string holder, wherein the raising or lowering of the point of contact is relative to a plane of the acoustic guitar, and wherein the pivot channel is located between the anchor portion and the position adjuster.

16. The apparatus of claim 15, wherein the mount further comprises an extension configured to pass through a bridge hole in the acoustic guitar and oriented orthogonal to the plane the acoustic guitar.

17. The apparatus of claim 16, where in the extension is threaded.

18. The apparatus of claim 16, wherein the extension is threaded for receiving a threaded fastener.

* * * * *